US006932248B2

(12) United States Patent
Fracasso

(10) Patent No.: US 6,932,248 B2
(45) Date of Patent: Aug. 23, 2005

(54) DISPENSING CAP FOR LIQUID CONTAINER

(75) Inventor: Giuseppe Fracasso, Caldogno (IT)

(73) Assignee: Giflor SNC di Fracasso Giuseppe & C., Grumolo delle Abbadesse (IT)

( * ) Notice: Subject to any disclaimer, the term of this patent is extended or adjusted under 35 U.S.C. 154(b) by 84 days.

(21) Appl. No.: 10/478,846

(22) PCT Filed: Apr. 24, 2003

(86) PCT No.: PCT/IB03/01615

§ 371 (c)(1),
(2), (4) Date: Nov. 25, 2003

(87) PCT Pub. No.: WO03/091125

PCT Pub. Date: Nov. 6, 2003

(65) Prior Publication Data

US 2004/0149785 A1 Aug. 5, 2004

(30) Foreign Application Priority Data

Apr. 24, 2002 (IT) ..... VI20020010 U

(51) Int. Cl.[7] ..... B65D 47/28

(52) U.S. Cl. ..... 222/522; 222/531; 222/553; 222/562

(58) Field of Search ..... 222/522, 526, 222/531, 537, 553, 562; 215/316, 322

(56) References Cited

U.S. PATENT DOCUMENTS 4,324,351 A * 4/1982 Meshberg ..... 222/402.11
4,767,034 A * 8/1988 Cramer ..... 222/525
4,852,774 A * 8/1989 Crawford ..... 222/562
5,016,787 A * 5/1991 Beck ..... 222/522
5,197,634 A * 3/1993 Beck ..... 222/553
5,271,524 A 12/1993 Marston ..... 222/1
5,377,870 A * 1/1995 Morel ..... 222/522
5,390,828 A * 2/1995 Gross ..... 222/531
5,996,859 A * 12/1999 Beck ..... 222/556
6,405,904 B1 * 6/2002 De Laforcade ..... 222/562

FOREIGN PATENT DOCUMENTS

| | | |
|---|---|---|
| EP | 0 257 426 | 3/1988 |
| EP | 0 567 374 | 10/1993 |
| FR | 2 698 078 | 5/1994 |
| WO | 91/08166 | 6/1991 |
| WO | 01/02264 | 1/2001 |

* cited by examiner

*Primary Examiner*—Eric Keasel
(74) *Attorney, Agent, or Firm*—Dykema Gossett PLLC

(57) ABSTRACT

A delivery cap for containers of liquids is disclosed comprising: a first cylindrical body with an outer wall with a lower threaded portion so as to be coupled with a threaded body belonging to the container and an inner wall coaxial to the first wall and defining together with a cylindrical central element an upper annular opening for liquid passage; a second cylindrical body coaxial to the first body and slidingly connected to the second inner wall of the first body, the second body having a cylindrical central wall defining together with the first body a chamber receiving the liquid coming out from the annular opening and ending with a duct for liquid discharge from the cap. The second body has a lid with a cylindrical edge portion sliding on the inner surface of the first outer wall belonging to the first body, the edge portion being linked with a lateral handling element with vertical development and slidingly coupled on the outer wall of the first body. The cylindrical central wall of the second body moves relative to the inner wall of the first body from a lower position closing the liquid delivery duct to a top position of duct opening.

9 Claims, 4 Drawing Sheets

DISPENSING CAP FOR LIQUID CONTAINER

The present invention relates to a delivery cap for containers of liquids and more particularly a delivery cap for delivery of liquids or creamy substances contained in a container such as detergents, soaps or other substances.

It is well known that on the market there are containers generally made of plastics, provided with caps screwed on the container neck and vertically moveable for a predetermined stretch so as to open or close a duct for delivery of liquid contained inside the container.

The caps of this kind mostly used are the so-called push-pull caps because their opening occurs pulling upwards with the fingers a moveable part of the cap, while closure of the delivery duct occurs lowering again on the container the cap part that was lifted.

This operation generally involves use of one hand for cap opening and closing operation, while the other hand is used to hold the container, also in view of the resistance to movement of the moveable part of the cap.

Moreover the shape of the cap, which is generally cylindrical or with double frustum conical taper, does not allow an easy cap opening and closing operation holding at the same time the container with one hand only.

The patent EP0567374 discloses a delivery cap generally comprising a first body applied to the neck of the container filled with the liquid, and a second body coaxially and slidingly coupled in the first body, from which a generally vertical tab is projecting.

Such a tab is in its turn slidingly coupled in a recess made on the lateral wall of the first body, and can be moved by the user upwards or downwards in a vertical direction whether or not he wants to obtain delivery of the liquid.

Although this embodiment on one hand allows the user to carry out the opening and closing operations of the cap with one hand only, on the other hand it has the drawback that when the cap or the user's hands are wet and slippery as it frequently occurs, actuation of the tab is problematic and the user must again use both hands to carry out efficiently said operations.

This is particularly clear when one wants to move the tab upwards to obtain delivery of liquid, as this operation requires a greater effort.

Moreover in view of the constructional design of said cap, the force required to handle the cap must win the friction between the mutually contacting surfaces of the first and second body of the cap.

Consequently the dimensional tolerances between the two bodies should not be great, thus causing a reduction of the cap seal.

The object of the present invention is to overcome the above mentioned drawbacks.

Indeed the object is to provide a delivery cap for liquid delivery, generally made of plastics, that can allow manipulation of the cap with one finger only instead of more fingers applied on the moveable part of the cap, for instance with the thumb moving upwards or downwards the moveable part of the cap so as to open and close it, thus making possible use of one hand only instead of both hands.

Another object is to obtain that the cap operation is carried out by applying a reduced force which is efficient even in particularly critical conditions for instance when the cap is wet.

Another object is also to provide a cap that can be manufactured easily and consisting of two parts only, preferably injection molded with thermoplastic material.

A further object is to provide a cap that once closed better warrants a tight seal so that the liquid does not come out even if the container is turned upside down with closed cap.

The foregoing and other objects that will be better described hereinafter are attained by a cap for containers of liquids that according to the contents of the main claim comprises:

- a first generally cylindrical body having an outer wall provided with a lower internally threaded part to be coupled with a corresponding externally threaded neck of said container and a generally cylindrical inner wall coaxial to said outer wall, defining together with a central cylindrical element, an annular top opening for passage of said liquid coming from said container;
- a second generally cylindrical body coaxial to said first body and slidingly connected to said inner wall of said first body through a generally cylindrical central wall defining together with said first body a chamber adapted to receive said liquid coming out from said annular opening and ending with a duct for discharge of liquid from said cap, said second body having a lid with a cylindrical edge portion sliding on the inner surface of said outer wall of said first body, and being linked with a lateral handling element with generally vertical development, sliding in a recess made on the outer wall of said first body, and wherein the lower edge of said recess is connected to said internal wall by an inclined plane extending upwards of said first body and cooperating with the free end of said handling element to move upwards said second body when said handling end is pushed against said inclined plane.

Advantageously according to the invention the handling element of the moveable cap body allows handling with one finger only to open and close the liquid delivery duct, while the same hand holds the container.

This happens also in the most difficult conditions of use, for instance when the cap or the user's hands are slippery.

The force transmitted through the pressure exerted by the user with the finger is indeed substantially radial and in view of the inclined plane, is resolved into a vertical component oriented upwards that lifts the second body.

Moreover in view of the radial operation, the user can give to the handling element a greater force then the force directly transmitted in the axial direction, thus increasing efficiency of the operation.

Moreover this involves advantageously that coupling between the surfaces of the second and first body is carried out with stricter tolerances relative to the prior art, thus increasing the sealing features of the cap.

Still advantageously the second body is centrally guided through the inner wall instead of the external one of the first body, allowing to reduce the cap size in comparison with equivalent caps of the prior art.

Moreover according to an embodiment of the invention, the liquid delivery duct is horizontally arranged on the moveable cap part. In this way particularly with containers provided with a handle, holding the container with one hand only and actuating the cap with the thumb, pouring made easier by the position of the delivery duct is obtained.

On the contrary another constructional variation provides that the delivery duct is arranged along the vertical axis as common for said kinds of caps.

Additional features and advantages of the invention will be better understood from the description of two preferred embodiments given as an illustrative but non limiting example and shown in the accompanying sheets of drawing in which.

Figure 1:
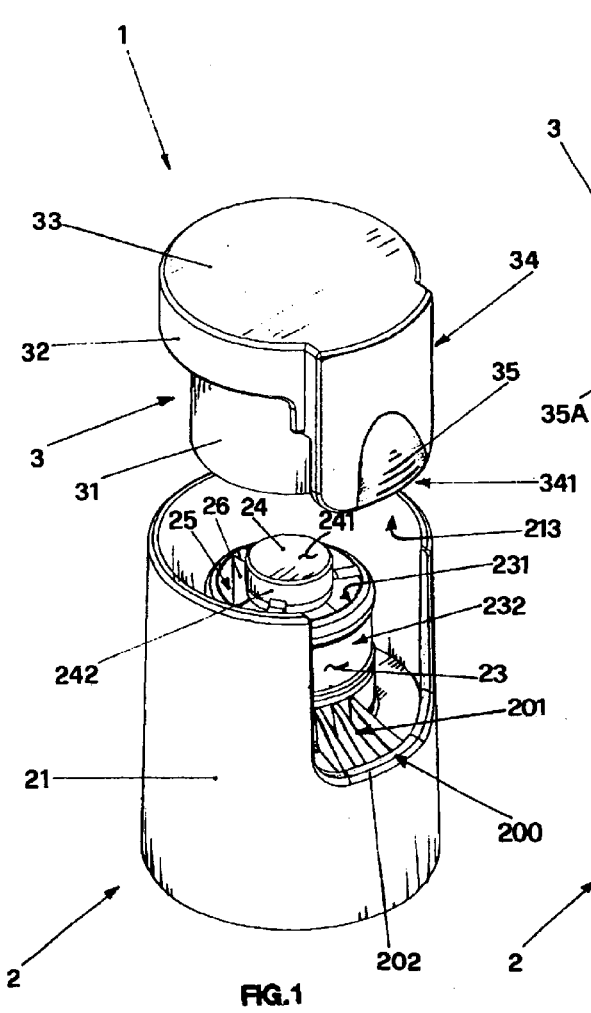
FIG. 1 is an isometric view of the cap of the invention seen from the handling element side.

With reference now of the above listed drawings and more particularly to FIGS. 1 to 4, one can see that the cap of the invention generally indicated with 1, has a first generally cylindrical body indicated with 2 to which a second body 3 is slidingly vertically connected.

The first body 2 has a cylindrical outer wall 21 having an internally threaded lower part 22 which is screwed on the externally threaded neck of a container not shown in the drawings.

Figure 2:
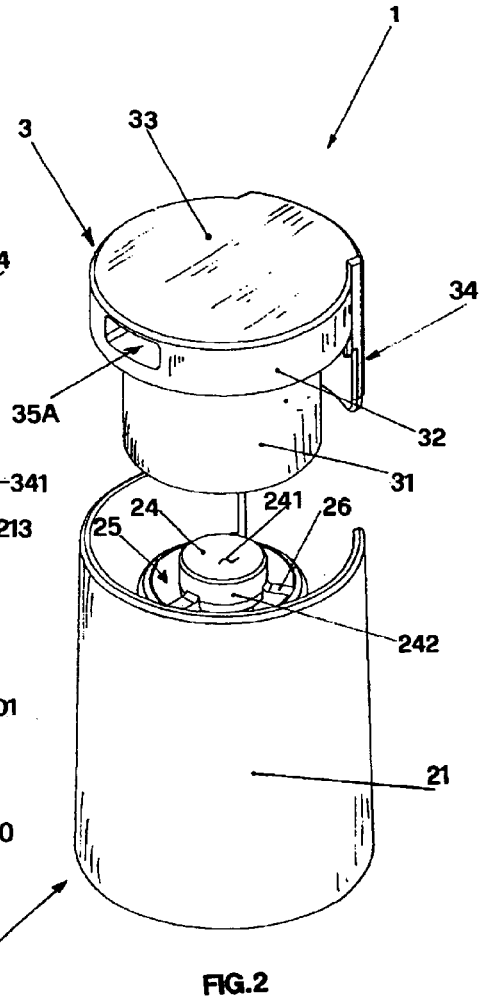
FIG. 2 shows the cap of FIG. 1 seen from the delivery duct side.

Said first body 2 has also an inner wall 23 coaxial to the first outer wall 22 and defining together with a central cylindrical element 24 to be seen particularly in FIGS. 1 and 2, an annular opening 25 through which the liquid coming from the container may pass.

The central cylindrical element 24 connected to the inner wall 23 through radial ribs 26, has a upper flat surface 241 and a cylindrical lateral surface 242 to be seen in FIGS. 1 and 2.

Therefore the inner surface 231 of the inner wall 23 and the surface 242 of the central element 24 define the annular opening 25 through which said liquid is passing. The inner wall 23 has an outer zone with cylindrical reduced surface indicated with 232 in FIG. 1.

The height of this zone defines travel of the second body 3 relative to the first body 2 as it will be discussed hereinafter.

Figure 3:
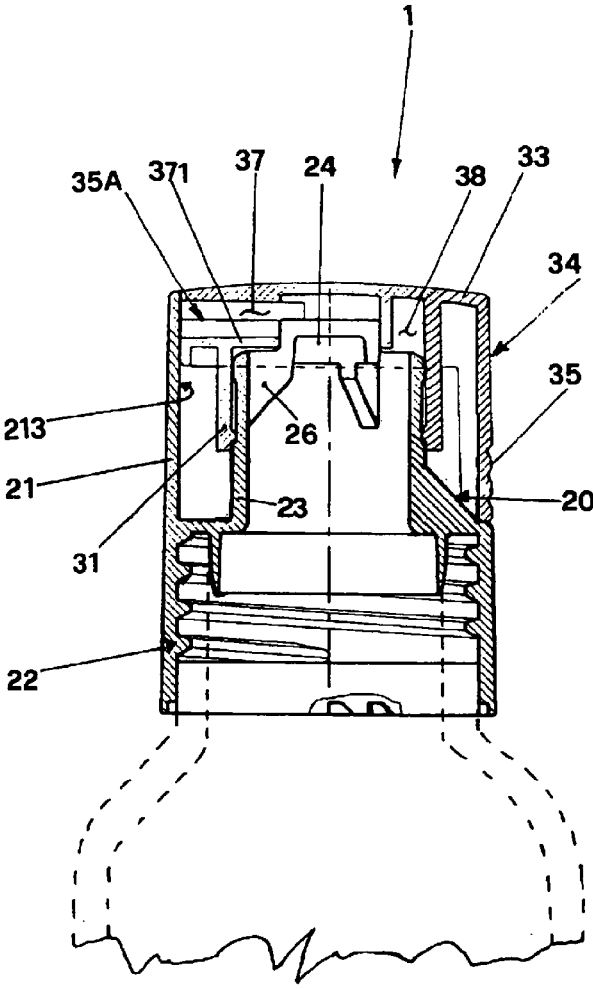
FIG. 3 is a sectional view of the cap of FIGS. 1 and 2 when the cap is in the closure position.
Figure 4:
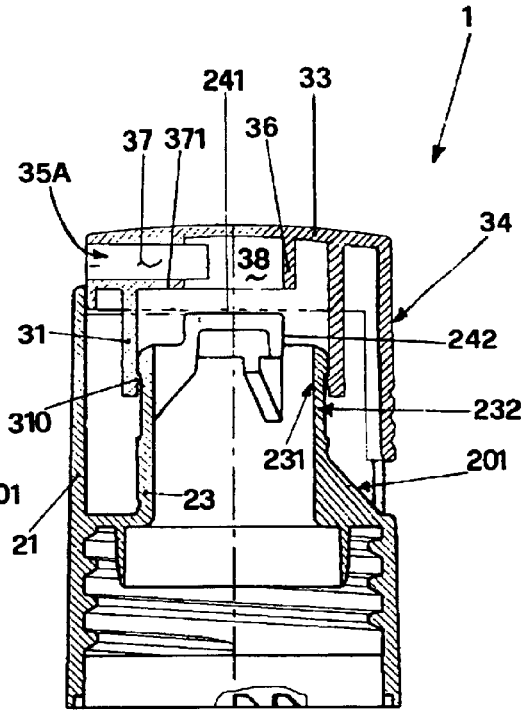
FIG. 4 is sectional view of the cap of FIGS. 1 and 2 when the cap is in the delivery position.
Figure 5:
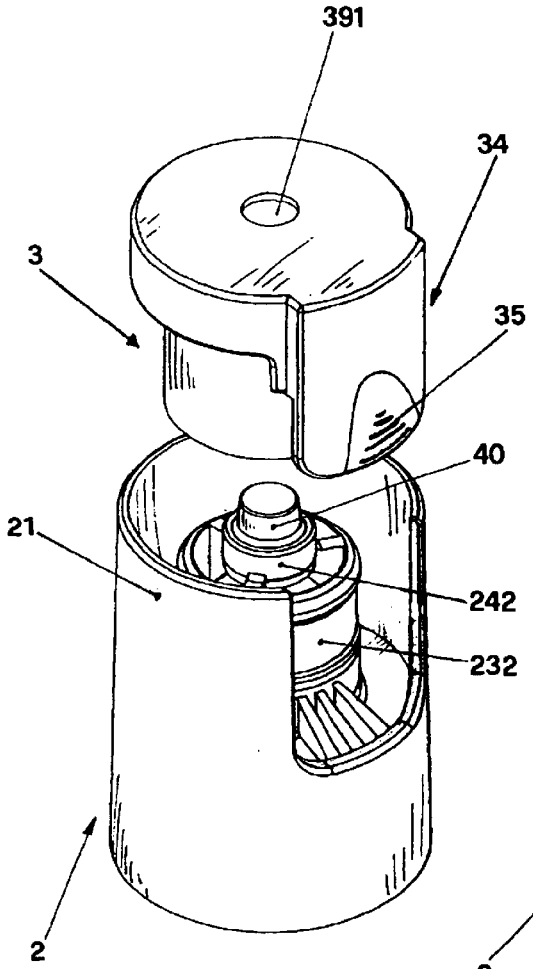
FIG. 5 is an isometric view of a constructional variation of the cap of the invention seen from the handling element side.
Figure 6:
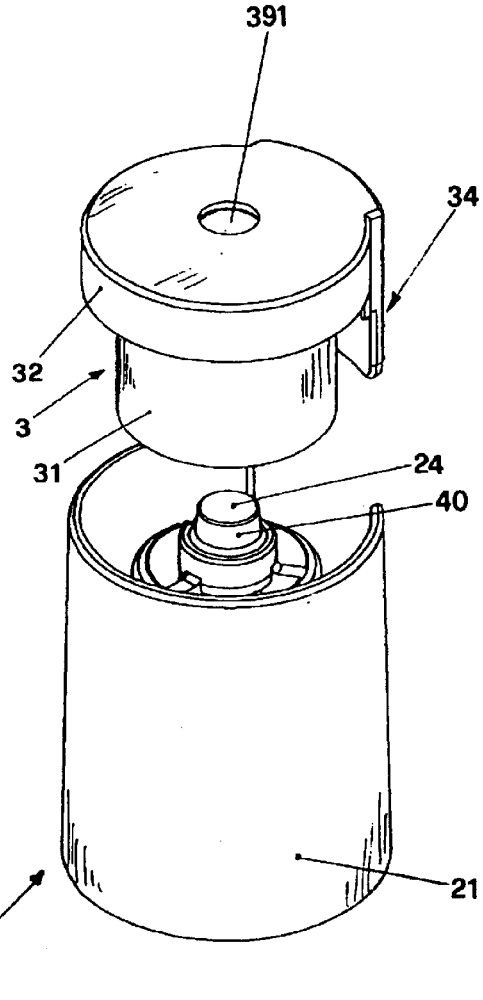
FIG. 6 shows the cap of FIG. 5 seen from the part opposite to the handling element.

The second body 3 is coaxial relative to the first body 2 and is slidingly connected to the inner wall 23 through a generally cylindrical central wall 31 defining together with said first body 2 a chamber 38 receiving the liquid coming out from the annular opening 25 and ending with a delivery duct 35A of said liquid as shown in FIGS. 3 and 4.

Moreover said second body 3 has a lid 33 with a cylindrical edge portion 32 generally sliding vertically on the inner surface 213 of the external wall 21 of the first body 2.

Said cylindrical edge portion 32 is connected to a flexible handling element 34 with a generally vertical development and sliding in a recess 200 made on the external wall 21 of said first body 2.

According to the invention, the lower edge 202 of the recess 200 is connected to the inner wall 23 through an inclined plane 201 extending upwards from the first body 2 and cooperating with the free end 341 of the handling element 34 in order to move upwards the second body 3 when the free end 341 is pushed against the inclined plane 201.

According to the preferred embodiment of the invention being disclosed, the inclined plane 201 comprises three ribs having a generally triangular profile when seen in longitudinal section.

Preferably but not necessarily the handling element 34 has at the free end 341 horizontal scores 35 to improve the finger contact with said handling element 34.

The second body 3 is centrally guided at its central wall 31, by the internal wall 23 of the first body 2, this constructional feature allowing to make the cap 1 of the invention with a reduced size in comparison with equivalent caps of the prior art.

The central wall 31 has also a protrusion 310 engaged on the corresponding reduced zone 232 belonging to the inner wall 23 of the first body 2, so as to define a bottom position corresponding to closure of the delivery duct 35A belonging to the second body 3 and a top position corresponding to opening of said duct 35A.

This duct belongs to the lid 33 of the second body 3 as shown in FIGS. 3 and 4, has a first cylindrical stretch with vertical axis indicated with 36 and a second generally horizontal tubular stretch 37. As shown in FIG. 3, when the cap is in the closed condition and therefore the second body 3 is lowered on the container, the surface 371 of the second tubular stretch 37 together with the first cylindrical stretch 36 of the delivery duct 35A warrant the tight seal together with the cylindrical central element 24 so that discharge of liquid is prevented.

Assuming now that the cap 1 of FIG. 3 is turned upside down together with the container and therefore the contained liquid is accumulated in the cap 1, it is to be noted that the only transfer way of the liquid from the container to the cap 1 is to fill the chamber 38 however without any action of discharging to the outside because such chamber is closed by the walls 31 and 23 of the first cylindrical stretch 36.

As shown coupling between the central wall 31 of the second body 3 and the internal wall 23 of the first body 2 is indeed carried out with very strict tolerances giving to the cap 1 of the invention high sealing features. In the delivery phase as shown in FIG. 4, the liquid on the contrary passes through opening 25 and reaches the tubular stretch 37 coming out from the cap.

The operation of the cap is as follows.

The user holds the container with one hand and with one finger only of the same hand actuates the handling element 34 pushing the free end 341 against the inclined plane 201 thus exerting a generally radial force. At the same time the user tilts the container so that the liquid may come out from the duct 35A.

With the simple starting action of pushing the free end 341 of the handling element 34, the second body 3 moves upwards thus allowing the liquid to pass from the container to the delivery duct 35A, traveling through the annular opening 25 of the cylindrical central element 24 and then to the outside.

When the user's finger brings back downwards the second body 3 pressing the finger on the lid 33, liquid deliver is over.

Thus it can be seen that with a rather easy operation requiring one hand only, this delivery cap warrants its complete functional capability.

More particularly the cap of the invention is adapted to be used with extreme easiness even when its grip should result so problematic as to cause the hand to slide on it.

Indeed the user exerting a radial force directed against an inclined plane 201, generates an axial component of the force pushing immediately upwards the second body 3 of the cap 1, thus opening the delivery duct 35A for the liquid allowing its delivery.

Figure 7:
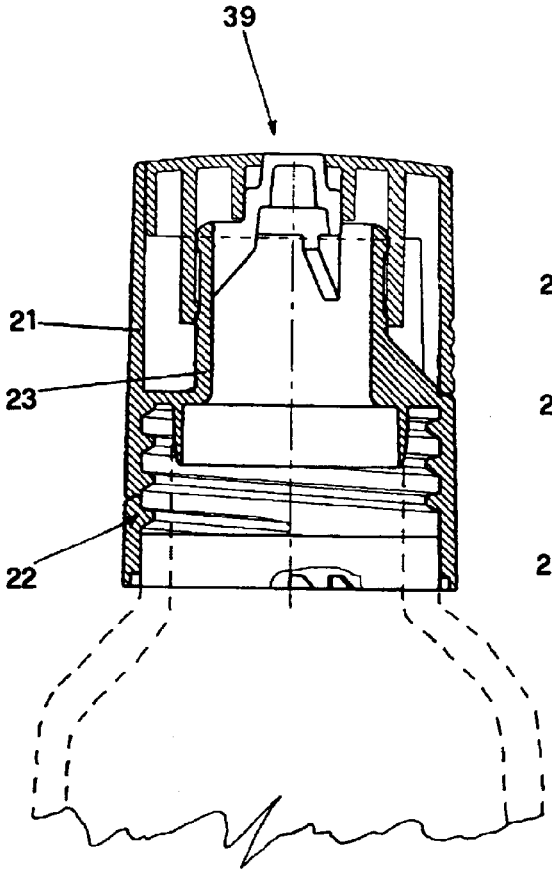
FIG. 7 is a sectional view of the cap of FIG. 5 when the cap is in the closed position.
Figure 8:
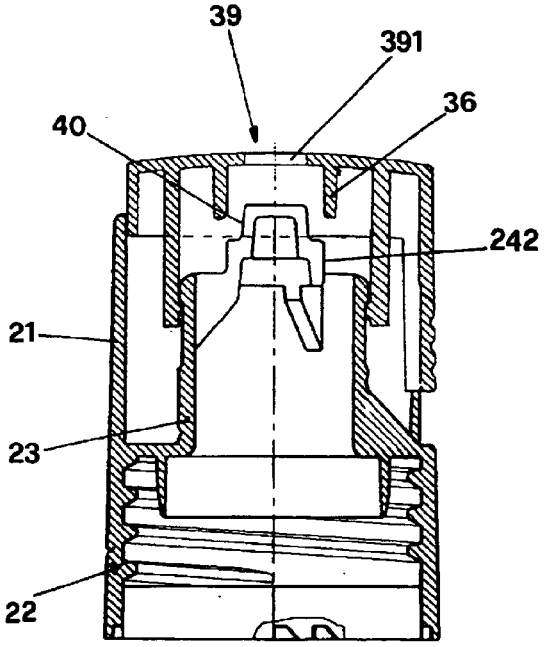
FIG. 8 is a sectional view of the cap of FIG. 5 when the cap is in the delivery position.

A constructional variation of the invention is shown in FIGS. 5 to 8, wherein the delivery duct now indicated with 39, is coaxial to the main cap axis and consists of a cylindrical cavity formed by the cylindrical wall 36 and the hole 391. In this embodiment as shown in FIGS. 7 and 8, the cap tightness in the closure position is warranted by the contact between the wall 36 and the cylindrical wall 242 belonging to the cylindrical central element of the first body 2.

The delivery hole 391 is closed by the frustum conical surface 40 that in this embodiment is superposed to the central cylindrical element 24.

For the rest the constructional features of both the first and the second cap bodies, of the handling element or any other detail are substantially identical as one can see from the drawings and therefore they do not need a detailed description.

It is to be noted that this solution with the delivery duct in a position coaxial to the main axis of the cap, is the traditional solution requiring to pour the contents a greater tilting of the container, while tilting of the container and of the cap in the preceding embodiment shown in FIGS. 1 to 4 is lower and therefore operation is considered to be easier.

On the basis of the foregoing it is to be understood that the delivery cap of the invention attains all the previously mentioned objects and advantages. In the constructional stage modifications may be made to the cap of the invention, for instance a different realization of the inclined plane on which the handling element is sliding, however without impairing the advantage given by the present patent.

What is claimed is:

1. A delivery cap for containers of liquids comprising:

a first generally cylindrical body having an outer wall provided with a lower internally threaded part to be coupled with a corresponding externally threaded neck of said container and a generally cylindrical inner wall coaxial to said outer wall, defining together with a central cylindrical element, an annular top opening for passage of said liquid coming from said container;

a second generally cylindrical body coaxial to said first body and slidingly connected to said inner wall of said first body through a generally cylindrical central wall defining together with said first body a chamber adapted to receive said liquid coming out from said annular opening and ending with a duct for discharge of liquid from said cap, said second body having a lid with a cylindrical edge portion sliding on the inner surface of said outer wall of said first body, and being linked with a lateral handling element with generally vertical development, sliding in a recess made on the outer wall of said first body, wherein the lower edge of said recess is connected to said internal wall by an inclined plane extending upwards of said first body and cooperating with the free end of said handling element to move upwards said the second body when said handling end is pushed against said inclined plane.

2. The cap according to claim 1) wherein said inclined plane comprises one or more ribs having a generally triangular profile when seen in longitudinal section.

3. The cap according to claim 1) wherein said handling element has the general shape of a cylindrical portion of the first outer wall belonging to said first body.

4. The cap according to claim 1) wherein said free end of said handling element has generally horizontal projecting ribs.

5. The cap according to claim 1) wherein said lid of said second body has a generally flat top surface.

6. The cap according to claim 1) wherein the delivery duct belonging to said second body has a first cylindrical stretch with vertical axis and a generally horizontal second tubular stretch.

7. The cap according to claim 6) wherein the tight closure of said delivery duct is obtained by contact between the walls of said first cylindrical stretch and said second tubular stretch of said delivery duct with the lateral walls of said central cylindrical element belonging to said first body.

8. The cap according to claim 1) wherein said delivery duct of said second body is a cylindrical cavity with vertical axis and coaxial to the axis of said second and first body ending with a generally circular hole.

9. The cap according to claim 8) wherein the tight closure of said delivery duct is obtained by contact of the wall of said cylindrical cavity of said second body with the lateral walls of said cylindrical central element belonging to said first body, said delivery hole being closed by a frustum conical surface superposed to said cylindrical central element.

* * * * *